US008125336B2

(12) United States Patent
Ieda et al.

(10) Patent No.: US 8,125,336 B2
(45) Date of Patent: Feb. 28, 2012

(54) ABNORMALITY DETECTING APPARATUS

(75) Inventors: Kiyokazu Ieda, Kariya (JP); Yuichi Murakami, Chiryu (JP); Hiroki Okada, Toyota (JP)

(73) Assignee: Aisin Seiki Kabushiki Kaisha, Kariya-Shi, Aichi-Ken (JP)

( * ) Notice: Subject to any disclaimer, the term of this patent is extended or adjusted under 35 U.S.C. 154(b) by 275 days.

(21) Appl. No.: 12/412,184

(22) Filed: Mar. 26, 2009

(65) Prior Publication Data

US 2009/0256704 A1 Oct. 15, 2009

(30) Foreign Application Priority Data

Apr. 11, 2008 (JP) ..... 2008-103870

(51) Int. Cl.
*G08B 13/18* (2006.01)

(52) U.S. Cl. ..... 340/555; 340/550; 359/273

(58) Field of Classification Search ..... 340/550, 340/545.4, 545.1, 545.2, 555; 359/273
See application file for complete search history.

(56) References Cited

U.S. PATENT DOCUMENTS

| | | | | |
|---|---|---|---|---|
| 6,535,126 | B2 * | 3/2003 | Lin et al. | 340/550 |
| 2003/0122556 | A1 | 7/2003 | Sueyoshi et al. | |
| 2007/0096905 | A1 | 5/2007 | Ieda et al. | |
| 2010/0214112 | A1 * | 8/2010 | Ishihara et al. | 340/686.1 |

FOREIGN PATENT DOCUMENTS

| | | | |
|---|---|---|---|
| CN | 1875384 | A | 12/2006 |
| JP | 2572576 | Y2 | 5/1998 |
| JP | 11-198648 | A | 7/1999 |
| JP | 2003-136957 | A | 5/2003 |
| JP | 2003-141649 | A | 5/2003 |
| JP | 2003-170739 | A | 6/2003 |
| JP | 2006-252499 | A | 9/2006 |
| JP | 2007-276561 | A | 10/2007 |
| WO | 03/054823 | A | 7/2003 |
| WO | WO 03054823 | A1 * | 7/2003 |

OTHER PUBLICATIONS

Search Report issued Jan. 4, 2010 by the European Patent Office in European Patent Application No. 09156294.2.
Official Action issued on Aug. 26, 2011 by the Chinese Patent Office in corresponding Chinese Patent Application No. 200910134901.9, and English language translation of the Official Action.

* cited by examiner

*Primary Examiner* — George Bugg
*Assistant Examiner* — Edny Labbees
(74) *Attorney, Agent, or Firm* — Buchanan, Ingersoll & Rooney PC

(57) ABSTRACT

An abnormality detecting apparatus includes a power supply portion applying a voltage to electrodes provided at both surfaces of a light control glass adapted to be provided at a vehicle to change a transparency of the light control glass, a detection portion detecting a detectable amount obtained on the basis of the voltage applied to the electrodes, and an abnormality determination portion determining whether or not an abnormality occurs to the light control glass based on a predetermined detectable amount and the detectable amount detected by the detection portion.

4 Claims, 4 Drawing Sheets

ABNORMALITY DETECTING APPARATUS

CROSS REFERENCE TO RELATED APPLICATIONS

This application is based on and claims priority under 35 U.S.C. §119 to Japanese Patent Application No. 2008-103870, filed on Apr. 11, 2008, the entire content of which is incorporated herein by reference.

FIELD OF THE INVENTION

This invention generally relates to an abnormality detecting apparatus.

BACKGROUND

In recent years, vehicle theft and theft of various equipment provided at an interior of a vehicle, and the like have frequently occurred. In the thefts, a case where a key cylinder of a vehicle door is broken to unlock a door lock of the vehicle door from the outside of the vehicle and a case where a window glass of the vehicle is broken to operate an inner lock of the vehicle door to thereby unlock the door lock from the inside of the vehicle are considered. When the vehicle door is unlocked in the aforementioned manners, an intrusion to the inside of the vehicle is easily executed.

In order to prevent unlocking of the vehicle door from the outside of the vehicle, the key cylinder is eliminated and, instead, a key-less entry system, an intelligent key, a smart key or the like is used to avoid the breakage of the key cylinder. Alternatively, a door lock system is changed to an electronic system. In addition, in order to prevent unlocking of the vehicle door from the inside of the vehicle, an alarm system that is activated when a sound of a broken window glass is detected, an apparatus for obscuring the inside of the vehicle by a change of color of the window glass, and the like have been proposed.

JP2572576Y (hereinafter referred to as Reference 1) discloses an antitheft device for a vehicle that sounds an alarm, and the like when detecting the sound of a broken window glass. The antitheft device disclosed in Reference 1 includes a function for preventing a wrong detection. JP2007-276561A and JP2003-136957A (hereinafter referred to as Reference 2 and Reference 3, respectively) each disclose an antitheft device for a vehicle that decreases visibility of an inside of the vehicle when it is seen through a window glass in a case where no passengers are present inside of the vehicle. JPH11-198648A (hereinafter referred to as Reference 4) discloses a pinch detection device for detecting an intrusion from between a window glass and a window frame by using an optical sensor provided at a center pillar. JP2003-141649A and JP2006-252499A (hereinafter referred to as Reference 5 and Reference 6, respectively) disclose a glass breakage detection device and a security system for detecting a glass breakage. JP2003-170739A (hereinafter referred to as Reference 7) discloses a window glass for a vehicle constituted by a heat reflecting glass, a power heated glass, or the like of which transmittance of a radio wave is enhanced.

According to the antitheft device disclosed in Reference 1, an addition of a microphone sensor is required to detect the sound of a broken window glass. In this case, the microphone sensor may mistakenly detect an external sound as that of the sound of a breaking glass. The antitheft devices disclosed in References 2 and 3 are technologies related to visibility effectiveness and thus are not able to detect an intrusion of an individual into the vehicle when the window glass is broken.

According to the pinch detection having an intrusion detecting unction disclosed in Reference 4, the optical sensor is provided at an upper portion in the vicinity of the window frame, which may be obtrusive for a passenger and a hindrance to an ingress and egress of the passenger. The glass breakage detection device disclosed in Reference 5 and the security system disclosed in Reference 6 each utilize a voltage when a window glass is broken and a voltage when the window glass is not broken. That is, the voltages before and after the window glass is broken are compared to detect if the window glass is broken. When the window glass is partially broken, i.e., not fully broken, the voltage specified to be a detection signal may be still applied to the detection portion because of a non-disconnection state of a resistor or a conductive wire provided at the window glass. Thus, even when the glass is broken, no difference is found between the voltages before and after the breakage of the glass, which may lead to a non-detection (i.e., wrong detection) of the breaking glass.

A need thus exists for an abnormality detecting apparatus which is not susceptible to the drawback mentioned above.

SUMMARY OF THE INVENTION

According to an aspect of the present invention, an abnormality detecting apparatus includes a power supply portion applying a voltage to electrodes provided at both surfaces of a light control glass adapted to be provided at a vehicle to change a transparency of the light control glass, a detection portion detecting a detectable amount obtained on the basis of the voltage applied to the electrodes, and an abnormality determination portion determining whether or not an abnormality occurs to the light control glass based on a predetermined detectable amount and the detectable amount detected by the detection portion.

BRIEF DESCRIPTION OF THE DRAWINGS

The foregoing and additional features and characteristics of the present invention will become more apparent from the following detailed description considered with reference to the accompanying drawings, wherein.

DETAILED DESCRIPTION

Figure 1:
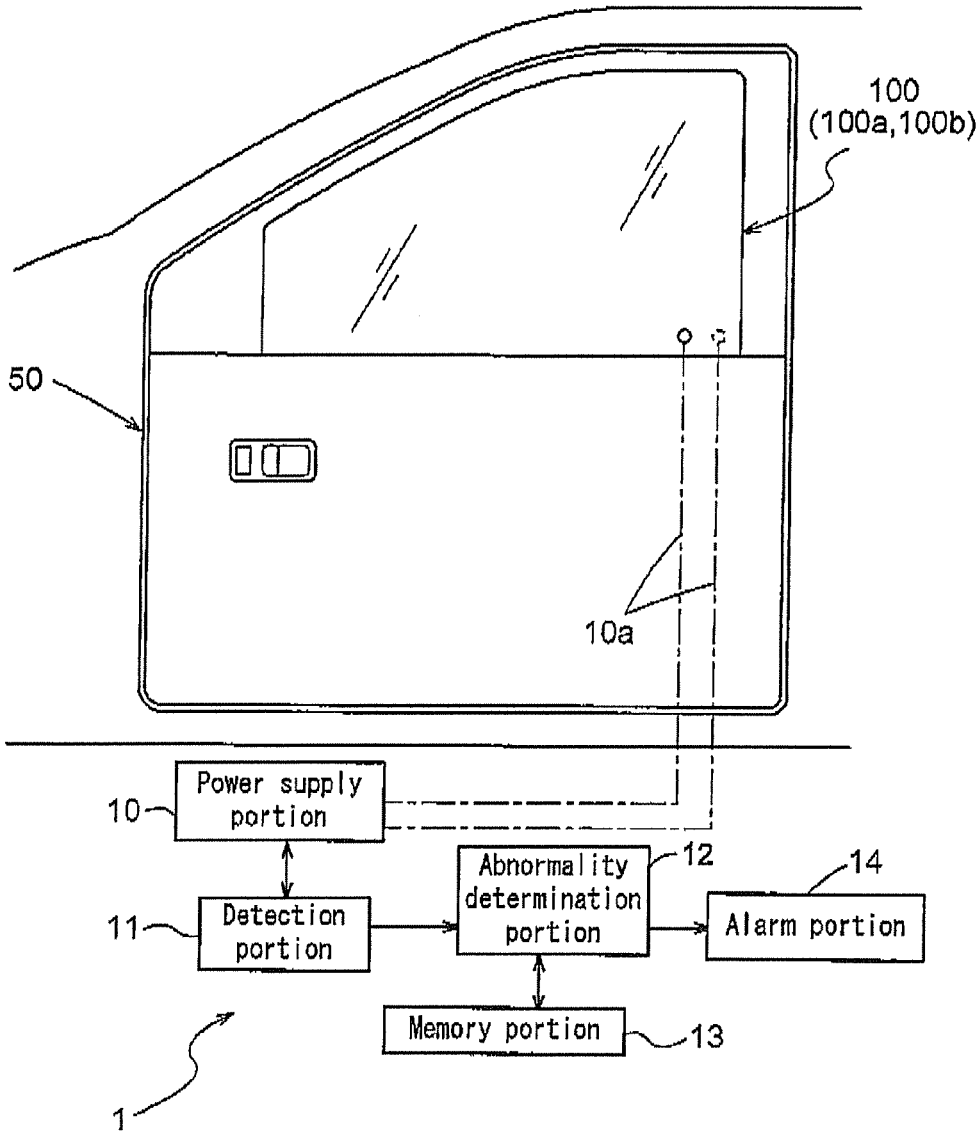
FIG. 1 is a block diagram schematically illustrating a structure of an abnormality detecting apparatus according to first and second embodiments of the present invention.

A first embodiment of the present invention will be explained with reference to the attached drawings. FIG. 1 is a block diagram schematically illustrating a structure of an abnormality detecting apparatus 1 according to the first embodiment. The abnormality detecting apparatus 1 includes a function for preventing vehicle theft and theft of various equipment provided within a vehicle, and the like. According to the first embodiment, an example where the abnormality detecting apparatus 1 is provided at a vehicle will be explained.

The abnormality detecting apparatus 1 includes functional portions such as a power supply portion 10, a detection portion 11, an abnormality determination portion 12, a memory portion 13, and an alarm portion 14. The abnormality detecting apparatus 1 includes a CPU (central processing unit) as a main member, and the functional portions of the abnormality detecting apparatus 1 are constituted by hardware and/or software for performing various operations relating to the abnormality detection. A structure of each portion of the abnormality detecting apparatus 1 will be explained below.

The power supply portion 10 applies a voltage (i.e., an applied voltage) to a pair of electrodes arranged at both surfaces of a light control glass 100 provided at a vehicle so as to change transparency of the light control glass 100. The light control glass 100 is able to change its transparency depending on an electrical current and/or a voltage applied to the pair of electrodes between which electrochromic material, liquid crystal material, or the like is sealingly filled. According to the light control glass 100 of the present embodiment, the transparency thereof is low in a state where the voltage is not applied to the light control glass 100. That is, the transparency of the light control glass 100 increases when the voltage is applied to the light control glass 100. In addition, the electrodes arranged at both surfaces of the light control glass 100 desirably indicate a change in transparency thereof. Accordingly, the electrodes are desirably made of a transparent material. In the following explanation, the electrodes will be described as transparent electrodes.

Figure 2:
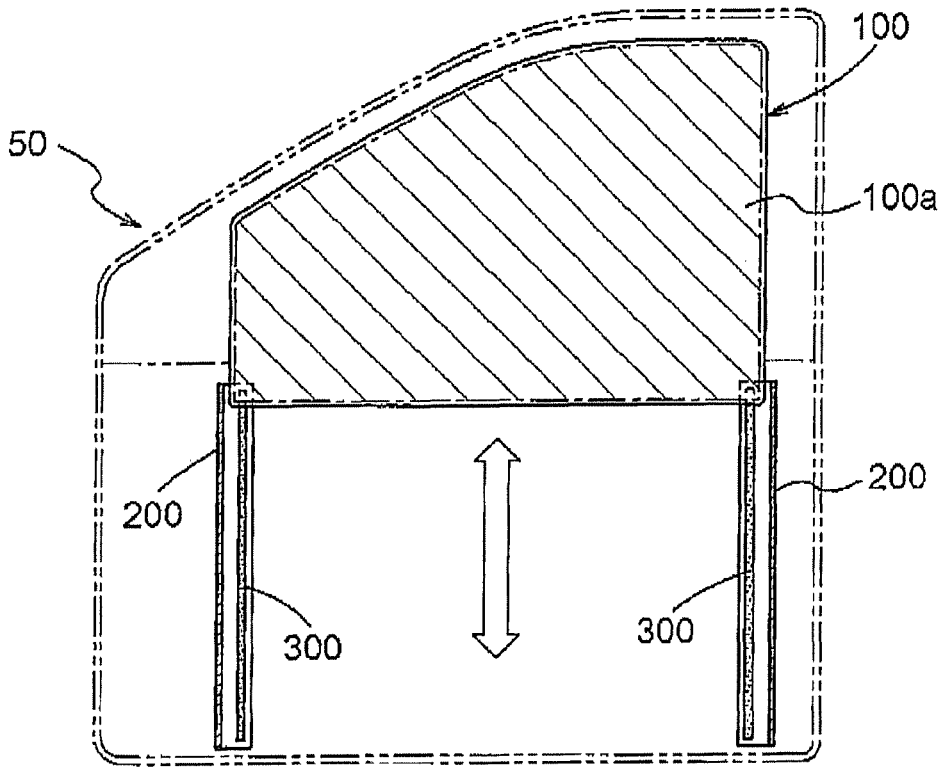
FIG. 2 is a diagram illustrating a connection between a power supply portion and a light control glass.

A method for applying the voltage from the power supply portion 10 to the light control glass 100 will be explained below. FIG. 2 illustrates a connection between the power supply portion 10 and the light control glass 100. The light control glass 100 is assembled onto glass guide rails 200 provided inside of a door panel 50 as illustrated in FIG. 2. In order to move the light control glass 100 up and down as in a hollow arrow direction in FIG. 2, two of the glass guide rails 200 are mounted to the light control glass 100. Consequently, in response to an operation of a glass opening/closing switch by a passenger of the vehicle, the light control glass 100 is movable up and down as shown by the hollow arrow along the glass guide rails 200.

Figure 3:
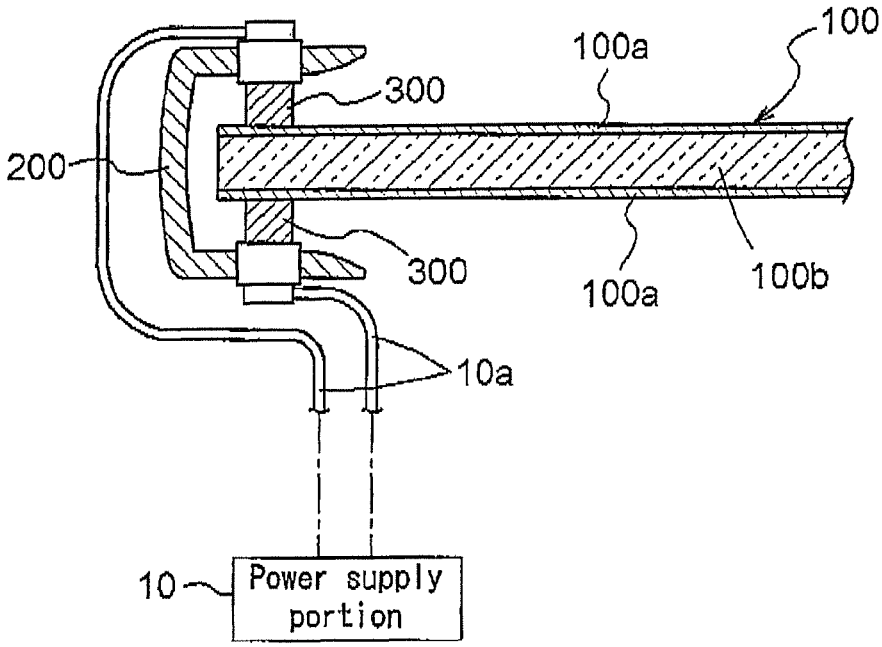
FIG. 3 is a diagram illustrating a connection between the light control glass and a glass guide rail.

FIG. 3 illustrates a connection between the light control glass 100 and the glass guide rails 200. In FIG. 3, a top cross-section of one of the glass guide rails 200 shown in FIG. 2 and a cross section of the light control glass 100 are illustrated. Transparent electrodes 100*a* are provided at both surfaces of the light control glass 100. A material 100*b* for changing the transparency of the light control glass 100 is sealingly filled in a portion between the transparent electrodes 100*a*.

The connection between the power supply portion 10 and the light control glass 100 is achieved by a contact of contact brushes 300 with the respective transparent electrodes 100*a*. Cables 10*a* connect the power supply portion 10 to the respective contact brushes 300. The contact brushes 300 are provided at each of the glass guide rails 200 and are used as connecting terminals with the respective transparent electrodes 100*a* provided at the both surfaces of the light control glass 100. Accordingly, the voltage is applied to the both surfaces of the light control glass 100.

In FIG. 1, the detection portion 11 detects a detectable amount obtained on the basis of the applied voltage. As described above, the applied voltage is a voltage applied from the power supply portion 10 to the transparent electrodes 100*a*. Then, the detectable amount is an input current flowing while the power supply portion 10 is applying the voltage. Thus, according to the present embodiment, the detection portion 11 includes a function for measuring a value of the current. The detection portion 11 measures the input current while the power supply portion 10 is applying the voltage. This measurement may be achieved by an induced electromotive force, a mutual induction, and the like using a pick-up coil, a transformer, and the like. Alternatively, the measurement may be achieved by use of a resistor divider. The detection result from the detection portion 11 is transmitted to the abnormality determination portion 12.

The abnormality determination portion 12 determines whether or not an abnormality exists in the light control glass 100 based on the detectable amount specified beforehand (i.e., a predetermined detectable amount) and the detectable amount detected by the detection portion 11. The detectable amount is the input current to the transparent electrodes 100*a* as mentioned above. The predetermined detectable amount, i.e., a predetermined input current, is stored in the memory portion 13. The predetermined input current corresponds to a threshold value for determining a variation of the input current measured by the detection portion 11. For example, in a case where the light control glass 100 is broken for any reason, the input current to the transparent electrodes 100*a* changes along with the breakage of the light control glass 100. Thus, the input current obtained when the light control glass 100 is not broken, which is defined as the predetermined input current, and the input current measured by the detection portion 11 are compared to thereby determine whether or not the abnormality such as a breakage occurs to the light control glass 100. Accordingly, the abnormality determination portion 12 determines the variation of the input current measured by the detection portion 11 based on the predetermined input current as the threshold value. Then, on the basis of the determination result, the abnormality determination portion 12 determines whether or not the abnormality exists in the light control glass 100. The determination result is transmitted to the alarm portion 14.

The memory portion 13 stores the threshold value for determining the variation of the input current measured by the detection portion 11. The threshold value is obtainable by, for example, the input current which is measured beforehand in a state where the light control glass 100 is not in the abnormal state and in which a predetermined variation is included.

The alarm portion 14 informs, i.e., alerts an owner, and the like of the vehicle that the abnormality occurs to the light control glass 100 on the basis of the determination result of the abnormality determination portion 12. The alert may be executed by an audible output of a siren or a voice from a speaker provided in the vehicle. Alternatively, the abnormality may be alerted to an owner of a vehicle, a security center, and the like by means of a communication function provided at the vehicle. Still alternatively, a control related to the alarm may be performed in conjunction with a security system provided in the vehicle.

Figure 4:
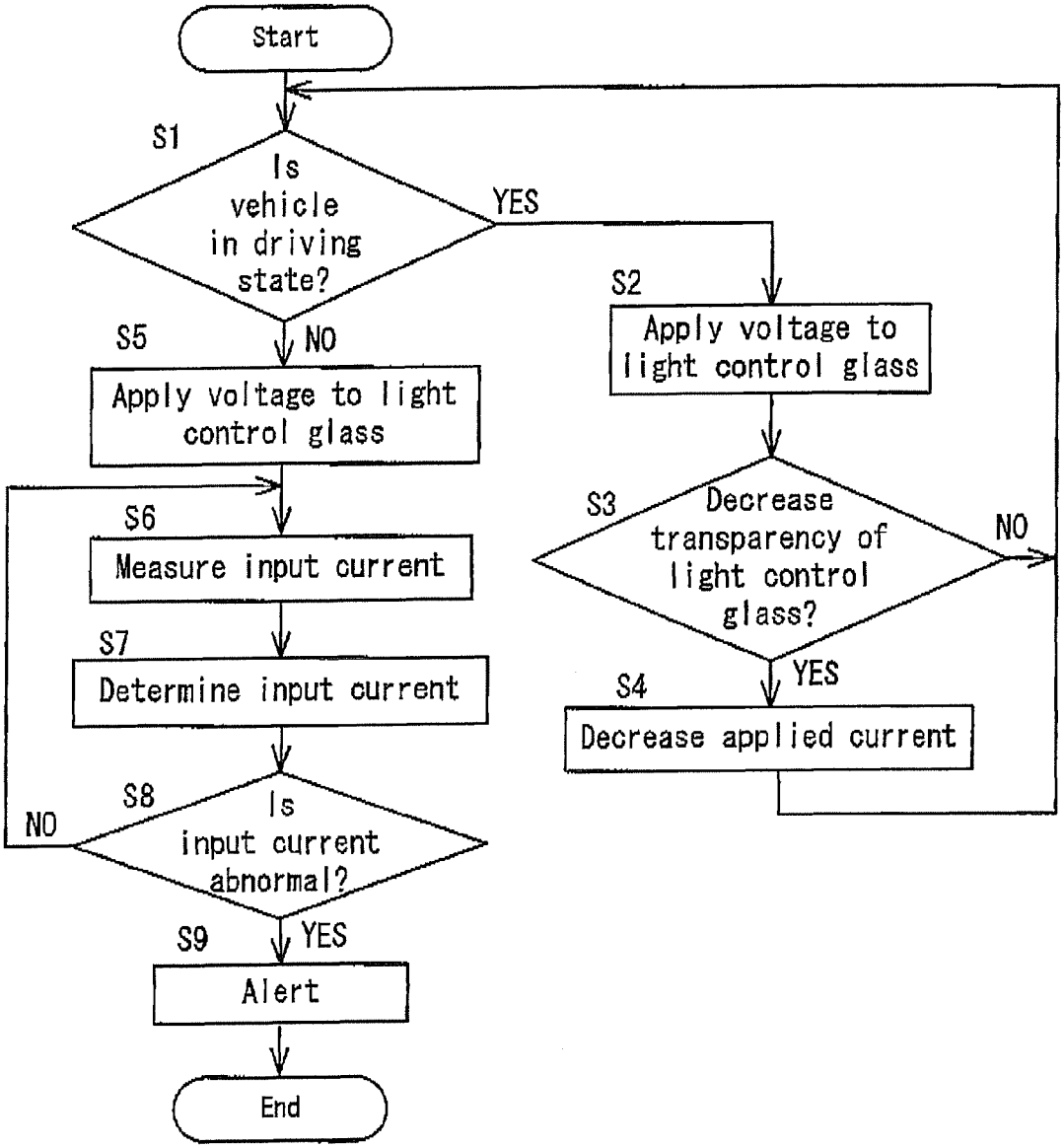
FIG. 4 is a flowchart illustrating a control of the abnormality detecting apparatus.

Next, a control performed by the abnormality detecting apparatus 1 will be explained with reference to a flowchart. FIG. 4 is a flowchart illustrating the control performed by the abnormality detecting apparatus 1. First, it is determined whether or not the vehicle is in a driving state in step 1 (which will be hereinafter referred to as "S1" and subsequent steps will also be referred to as "S2", "S3", and the like). The determination whether the vehicle is in the driving state or not may be based on whether or not an engine is turned on or whether or not the power is supplied to the engine. When it is determined that the vehicle is in the driving state, the power supply portion 10 applies a set voltage to the transparent electrodes 100*a* of the light control glass 100 so that the transparency of the light control glass 100 changes to a set transparent level for the purpose of securing a visibility of a user of the vehicle in S2. At this time, the driving state of the vehicle includes not only a state where the vehicle is being driven but also a state where a user or a passenger of the vehicle is within the vehicle with an intention of driving the vehicle.

In the aforementioned state, the transparency of the light control glass 100 is specified to be high. In a case of decreasing the transparency of the light control glass 100 having the high transparency in S3, the power supply portion 10 decreases the applied voltage in S4. The transparency of the light control glass 100 decreases accordingly. Then, the operation returns to S1 to continue the process. On the other hand, in a case of not decreasing the transparency of the light control glass 100 in S3, the operation returns to S1 to continue the process.

In S1, when it is determined that the vehicle is not in the driving state, the power supply portion 10 applies the voltage to the light control glass 100 so as to detect the abnormality thereof in S5. At this time, the transparency of the light control glass 100 increases.

In the aforementioned state, the detection portion 11 measures the input current flowing to the light control glass 100 in S6. The measurement result by the detection portion 11 is transmitted to the abnormality determination portion 12. The abnormality determination portion 12 determines whether or not the input current detected by the detection portion 11 is in a normal state in S7 based on the predetermined input current, i.e., the input current obtained in the normal state of the light control glass 100 and stored in the memory portion 13. When it is determined that the input current measured by the detection portion 11 is in the normal state, the operation returns to S6 to continue measuring the input current.

On the other hand, when it is determined that the input current measured by the detection portion 11 is in an abnormal state, the alarm portion 14 alerts an owner, and the like of the vehicle to the abnormality of the light control glass 100 in S9. According to the abnormality detecting apparatus 1 of the present embodiment, the voltage is applied to the light control glass 100 when the vehicle is not in the driving state so as to detect whether or not the abnormality exists in the light control glass 100 and to further detect whether or not the abnormality exists in the vehicle.

Next, a second embodiment of the abnormality detecting apparatus 1 will be explained blow. In the first embodiment, the detectable amount detected by the detection portion 11 is the input current flowing to the transparent electrodes 100*a* of the light control glass 100. In the second embodiment, the detectable amount detected by the detection portion 11 is a capacitance generated at the transparent electrodes 100*a* of the light control glass 100. The block diagram for other portions according to the second embodiment is same as that illustrated in FIG. 1. Thus, FIG. 1 will be used for explaining the second embodiment below.

The power supply portion 10 applies the voltage (i.e., applied voltage) to the transparent electrodes 100*a* provided at both surfaces of the light control glass 100 provided at the vehicle. The connection between the transparent electrodes 100*a* and the power supply portion 10 is same as that according to the first embodiment and thus the explanation will be omitted.

The detection portion 11 detects the detectable amount obtained on the basis of the applied voltage. The applied voltage is obtained from the aforementioned power supply portion 10. The detectable amount according to the second embodiment is the capacitance generated at the transparent electrodes 100*a* while the power supply portion 10 is applying the voltage. Thus, the detection portion 11 detects and measures the capacitance generated at the transparent electrodes 100*a* in response to the applied voltage from the power supply portion 10.

The abnormality determination portion 12 determines whether or not the abnormality occurs to the light control glass 100 based on the predetermined detectable amount and the detectable amount detected by the detection portion 11. In this case, the detectable amount is the capacitance as mentioned above. In addition, the predetermined detectable amount is the capacitance stored at the memory portion 13 beforehand. The predetermined detectable amount corresponds to a threshold value for determining the variation of the capacitance measured by the detection portion 11. For example, in a case where the light control glass 100 is broken for some reason, the capacitance changes along with the breakage of the light control glass 100. Thus, by comparison between the predetermined capacitance obtained in a state where the light control glass 100 is not broken and the capacitance measured by the detection portion 11, it is detectable whether or not the abnormality such as the breakage occurs to the light control glass 100. Accordingly, the abnormality determination portion 12 determines the variation of the capacitance measured by the detection portion 11 based on the predetermined capacitance serving as the threshold value and then determines, on the basis of the determination result, whether or not the abnormality occurs to the light control glass 100. The determination result of the occurrence of the abnormality is transmitted to the alarm portion 14.

The memory portion 13 stores the threshold value used for determining, by the abnormality determination portion 12, the variation of the capacitance measured by the detection portion 11. The threshold value is obtainable by, for example, the capacitance which is measured beforehand in a state where the light control glass 100 is not in the abnormal state and in which a predetermined variation is included.

The alarm portion 14 alerts an owner, and the like that the abnormality occurs to the light control glass 100 on the basis of the determination result of the abnormality determination portion 12. The alert may be executed by an audible output of a siren or a voice from a speaker provided at the vehicle. Alternatively, the abnormality may be alerted to an owner of a vehicle, a security center, and the like by means of a communication function provided at the vehicle. Still alternatively, a control related to the alarm may be performed in conjunction with a security system provided at the vehicle.

Figure 5:
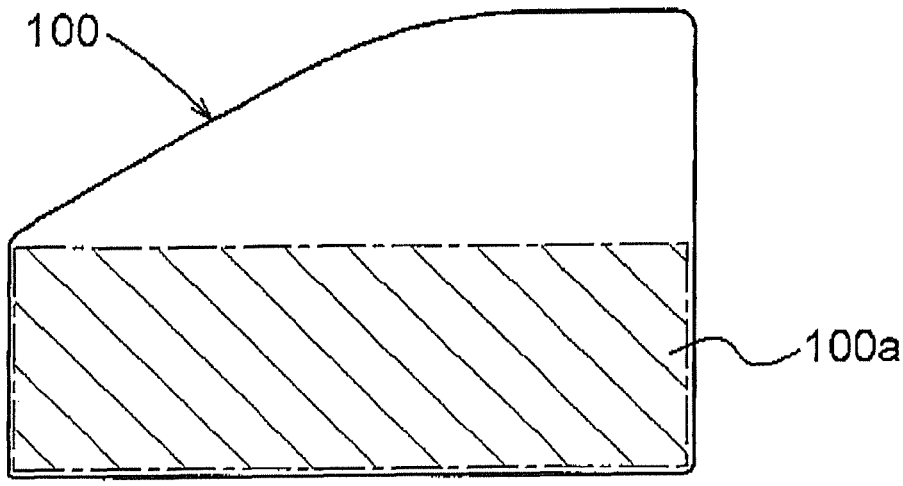
FIG. 5 is a diagram illustrating an example of a transparent electrode.
Figure 6:
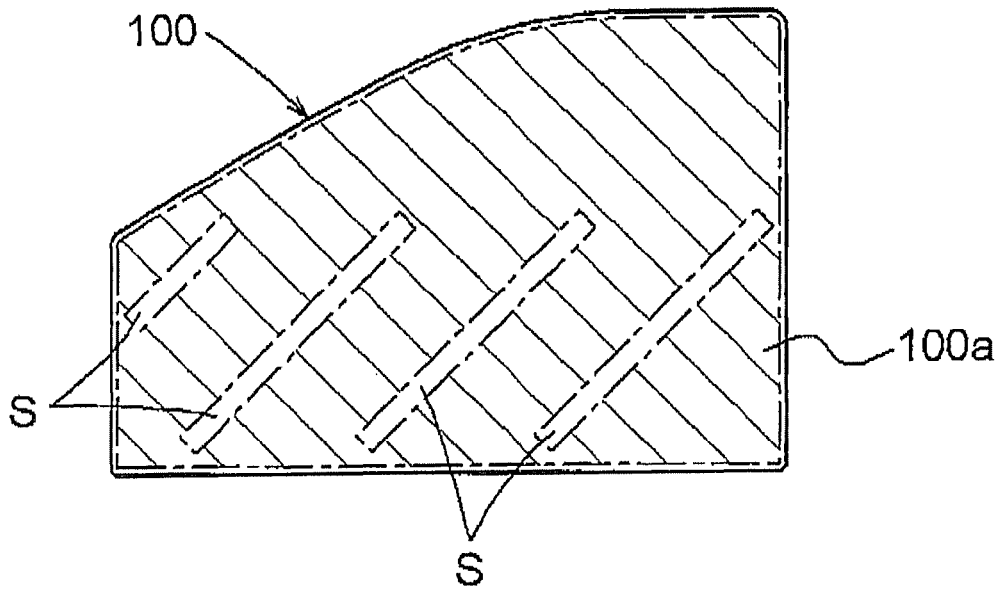
FIG. 6 is a diagram illustrating another example of the transparent electrode.

According to the aforementioned first and second embodiments, the transparent electrodes 100*a* are provided at both surfaces of the light control glass 100. In this case, each of the transparent electrode 100*a* is not limited to be provided at the entire surface of the light control glass 100 as illustrated by diagonal lines in FIG. 1. For example, as illustrated by a shaded area in FIG. 5, the transparent electrode 100*a* may be provided at only a lower half of the light control glass 100. When the light control glass 100 is used in such condition, an upper half of the light control glass 100 where the transparent electrode 100*a* is not provided may be constituted by a commonly used glass while the lower half of the light control glass 100 may be constituted by the light control glass 100. Further, as illustrated in FIG. 6, slits S may be formed as portions where the transparent electrode is not provided.

The case where the transparent electrode 100*a* is provided only at the lower half of the light control glass 100 is effective when an inner door lock is unlocked from the inside of the vehicle through the broken light control glass 100. In addition, the case where the slits S are formed as the portions where the transparent electrode 100*a* is not provided is effective to prevent a communication function provided at the vehicle from being interfered.

According to the first embodiment, the transparency of the light control glass 100 is low when the voltage is not applied. Alternatively, the transparency of the light control glass 100 may be high when the voltage is not applied, i.e., the transparency of the light control glass 100 may decrease when the voltage is applied. Further, a liquid crystal or the like may be used instead of the light control glass 100.

According to the second embodiment, the capacitance generated at the transparent electrodes 100*a* is measured by the detection portion 11. Alternatively, in a case where the vehicle is equipped with a human body detecting apparatus for detecting a passenger, a user, and the like making contact with a door knob on the basis of a capacitance varying depending on the contact of such passenger with the door knob, a capacitance detection portion provided at the human body detecting apparatus for detecting the variation of the capacitance may be used as the detection portion 11 of the abnormality detecting apparatus 1. Because of such structure, a decrease of the number of components is enhanced, thereby achieving a reduction of a cost and saving space.

According to the first and second embodiments, the abnormality of the light control glass 100 is detected on the basis of the input current or the capacitance. Alternatively, the abnormality may be determined by a monitoring of a battery voltage. According to such structure, in a case where the battery voltage significantly decreases for some reason and thus the input current fluctuates, a wrong detection that the abnormality occurs to the light control glass 100 may be prevented.

Further, according to the first and second embodiments, the abnormality of the light control glass 100 is detected on the basis of the input current or the capacitance. In such detection, it is desirable that the abnormality is detected when a differential value of the input current or the capacitance (i.e., variation of the input current or the capacitance during a predetermined time period) is equal to or greater than a predetermined value. Further, in order to prevent a wrong determination of the abnormality of the light control glass 100 when the input current or the capacitance is subjected to a temperature change or a temporal change, the input current or the capacitance upon start of the abnormality detection, and the input current or the capacitance during the abnormality detection may be compared so as to determine the abnormality.

For example, the detectable amount obtained on the basis of the voltage applied to the transparent electrodes 100*a* provided at the both surfaces of the light control glass 100 in a case where the transparent electrode 100*a* is damaged along with the breakage of the light control glass 100 is different from the detectable amount in a case where the light control glass 100 is not broken (i.e., the predetermined detectable amount). Thus, by the comparison between the predetermined detectable amount that is regarded as the detectable amount obtained in a state where the light control glass 100 is not broken and the detectable amount obtained on the basis of the voltage actually applied to the transparent electrodes 100*a*, the abnormality that occurs to the light control glass 100 is easily and appropriately detectable. In addition, because the transparent electrodes 100*a* are used as the electrodes, an original appearance of the light control glass 100 is prevented from being disturbed, thereby constituting the light control glass 100 without a provision of an obtrusive member.

The detectable amount detected by the detection portion 11 is the input current flowing to the transparent electrodes 100*a* while the voltage is being applied thereto.

According to the aforementioned structure, even when the transparency of the light control glass 100, of which transparency is low in a state where the voltage is not applied to the light control glass 100, becomes high, the active application of the voltage to the transparent electrodes 100*a* enables the detection of the abnormality of the light control glass 100 for preventing vehicle theft and theft of various equipment provided at the vehicle, and the like. In addition, in a case where the transparency of the light control glass 100 is high with no voltage applied, the inside of the vehicle in a stopped state is obscured by the application of the voltage to the transparent electrodes 100*a* and also the abnormality of the light control glass 100 is detectable. Even when the light control glass 100 is not fully broken, impedance varies in response to the breakage of the transparent electrode 100*a*, which leads to a large variation of the input current. Thus, without the wrong detection, the abnormality of the light control glass 100 is securely detected.

The detectable amount detected by the detection portion 11 is the capacitance generated at the transparent electrodes 100*a* while the voltage is being applied thereto.

According to the aforementioned structure, the abnormality of the light control glass 100 is detectable on the basis of the change of the capacitance generated at the transparent electrodes 100*a*. In addition, even when the light control glass 100 is not fully broken, an area of the transparent electrode 100*a* changes in response to the breakage or damage thereof, which leads to a large change of the capacitance. Thus, without the wrong detection, the abnormality is securely detected. Further, the capacitance changes when the light control glass 100 is pressed by a hand of an individual when he/she looks into the vehicle, and therefore the abnormality is detectable before the light control glass 100 is broken.

The vehicle includes a human body detecting apparatus for detecting a human body making contact with a door knob provided at the vehicle on the basis of the capacitance varying depending on a contact of the human body with the door knob, and a capacitance detection portion provided at the human body detecting apparatus is used as the detection portion 11.

When the capacitance detection portion provided at the human body detecting apparatus of a capacitance detection type is used as the detection portion 11 of the abnormality detecting apparatus 1 according to the second embodiment, the number of members or components decreases. As a result, a reduction of a cost and a space saving are achieved.

The transparent electrode 100*a* is partially provided at the light control glass 100.

According to the aforementioned structure, when the transparent electrode 100*a* is only provided at a portion of the light control glass 100 that is likely to be broken, such as a portion close to an inner lock inside of the vehicle, the portion is intensively detected. As compared to a case where the transparent electrode 100*a* is fully provided at the surface of the light control glass 100, a loss of a radio wave received by and transmitted from a communications equipment provided at the vehicle is restrained.

The abnormality detecting apparatus 1 further includes the alarm portion 14 informing of an occurrence of the abnormality in the light control glass 100 based on the determination result of the abnormality determination portion 12.

According to the aforementioned structure, when the abnormality occurs to the light control glass 100, the abnormality is immediately informed or alerted to a surrounding area, to an owner of a vehicle, a security center, and the like by means of a communication function provided at the vehicle. Alternatively, in conjunction with a security system already provided at the vehicle, an antitheft means for a vehicle is strengthened with a low cost.

The principles, preferred embodiment and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

The invention claimed is:

1. An abnormality detecting apparatus comprising:

a power supply portion applying a voltage to electrodes provided at surfaces of a light control glass adapted to be provided at a vehicle to change a transparency of the light control glass;

a detection portion detecting a detectable amount obtained on the basis of the voltage applied to the electrodes;

an abnormality determination portion determining whether or not an abnormality occurs to the light control glass based on a predetermined detectable amount and the detectable amount detected by the detection portion;

the detectable amount detected by the detection portion is a capacitance generated at the electrodes while the voltage is being applied thereto;

the vehicle includes a human body detecting apparatus for detecting a human body making contact with a door knob of the vehicle on the basis of the capacitance varying depending on a contact of the human body with the door knob; and a capacitance detection portion provided at the human body detecting apparatus is used as the detection portion.

2. The abnormality detecting apparatus according to claim 1, wherein the detectable amount detected by the detection portion is an input current flowing to the electrodes while the voltage is being applied thereto.

3. The abnormality detecting apparatus according to claim 1, wherein the electrode is partially provided at the light control glass.

4. The abnormality detecting apparatus according to claim 1, further comprising an alarm portion informing of an occurrence of the abnormality in the light control glass based on a determination result of the abnormality determination portion.

* * * * *